US007123231B2

(12) United States Patent
Honda

(10) Patent No.: US 7,123,231 B2
(45) Date of Patent: Oct. 17, 2006

(54) DRIVING CIRCUIT FOR LIQUID CRYSTAL DISPLAY

(75) Inventor: Takashi Honda, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 499 days.

(21) Appl. No.: 10/724,070

(22) Filed: Dec. 1, 2003

(65) Prior Publication Data

US 2004/0113880 A1 Jun. 17, 2004

(30) Foreign Application Priority Data

Dec. 2, 2002 (JP) ..... 2002-349431

(51) Int. Cl.
*G09G 3/36* (2006.01)

(52) U.S. Cl. ..... 345/96; 345/211; 345/87

(58) Field of Classification Search ..... 345/87–100, 345/204–205, 208–214
See application file for complete search history.

(56) References Cited

U.S. PATENT DOCUMENTS 5,821,808 A * 10/1998 Fujima ..... 327/541
6,384,817 B1 * 5/2002 Janssen et al. ..... 345/204
6,580,258 B1 * 6/2003 Wilcox et al. ..... 323/282
6,985,142 B1 * 1/2006 Svensson et al. ..... 345/211
2003/0160749 A1 * 8/2003 Tsuchi ..... 345/87

FOREIGN PATENT DOCUMENTS

JP 11-095729 4/1999
JP 2002-229525 8/2002
JP 2002-258821 9/2002

* cited by examiner

*Primary Examiner*—Richard Hjerpe
*Assistant Examiner*—Mansour M. Said
(74) *Attorney, Agent, or Firm*—VolentineFrancos&Whitt, PLLC

(57) ABSTRACT

A discharge accelerating unit which accelerates a discharge of a capacitive load (floating capacitor C1) of a signal line when a positive polarity input gradation voltage DAC(P) decreases is provided for a positive polarity operating circuit. A charge accelerating unit which accelerates a charge of a capacitive load (floating capacitor C2) of a signal line when a negative polarity input gradation voltage DAC(N) decreases is provided for a negative polarity operating circuit. Good characteristics can be obtained irrespective of a switching period of the positive polarity operating circuit and the negative polarity operating circuit and luminance levels of adjacent dots. The number of devices which are added by the invention can be minimized.

4 Claims, 5 Drawing Sheets

DRIVING CIRCUIT FOR LIQUID CRYSTAL DISPLAY

BACKGROUND OF THE INVENTION

1. Field of the Invention

The invention relates to a driving circuit for a liquid crystal display.

2. Related Background Art

FIG. 5 is a circuit diagram of a conventional liquid crystal driving circuit.

From the top of the diagram, (a) shows a positive polarity operating circuit, (b) shows a negative polarity operating circuit, and (c) and (d) show time charts for the operations of those operating circuits in order.

Referring to the diagram, the conventional driving circuit for a liquid crystal display has a positive polarity feedback amplifier AMP(P) and a negative polarity feedback amplifier AMP(N). A positive polarity input gradation voltage DAC (P) is inputted to a (+) terminal of the positive polarity feedback amplifier AMP(P). A positive polarity output gradation voltage OUT(P) is supplied to a parasitic capacitor C1 such as a signal line via a control switch SW3.

Further, a negative polarity input gradation voltage DAC (N) is inputted to a (+) terminal of the negative polarity feedback amplifier AMP(N). A negative polarity output gradation voltage OUT(N) is supplied to a parasitic capacitor C2 such as a signal line via the control switch SW3. The positive polarity feedback amplifier AMP(P) and the negative polarity feedback amplifier AMP(N) are connected as a pair to the two signal lines. Ordinarily, in many cases, those two signal lines are connected to two liquid crystal dots adjacently arranged on a liquid crystal display apparatus. Further, the connection of the positive polarity feedback amplifier AMP(P) and the connection of the negative polarity feedback amplifier AMP(N) are alternately switched between the signal lines at a predetermined time interval. Such a switching operation is performed in order to prolong a life span of the liquid crystal display apparatus.

The positive polarity feedback amplifier AMP(P) and the negative polarity feedback amplifier AMP(N) are voltage followers for outputting a voltage which is equal to an input voltage irrespective of magnitude of loads (parasitic capacitors C1 and C2 of the signal lines here). The voltage which becomes equal to ½ of a power voltage VDD is defined to be an intermediate voltage VM here.

An input voltage which is increased/decreased in the direction of the power voltage VDD in the case where the intermediate voltage VM is set to a reference voltage is defined as a positive polarity input gradation voltage DAC (P). An input voltage which is increased/decreased in the direction of a ground voltage VSS in the case where the intermediate voltage VM is set to the reference voltage is defined as a negative polarity input gradation voltage DAC (N). Similarly, an output voltage which is increased/decreased in the direction of the power voltage VDD in the case where the intermediate voltage VM is set to the reference voltage is defined as a positive polarity output gradation voltage OUT(P). An output voltage which is increased/decreased in the direction of the ground voltage VSS in the case where the intermediate voltage VM is set to the reference voltage is defined as a negative polarity output gradation voltage OUT(N).

That is, the positive polarity gradation voltage is a gradation voltage which increases like VU1, VU2, and VU3 toward the power voltage VDD in the case where the intermediate voltage VM is set to the reference. The negative polarity gradation voltage is a gradation voltage which increases like VD1, VD2, and VD3 toward the ground voltage VSS in the case where the intermediate voltage VM is set to the reference.

Ordinarily, for example, in the case of using a nematic liquid crystal, intensity of an electric field which is applied to the liquid crystal at the intermediate voltage VM becomes equal to 0 by another construction (not shown), so that the liquid crystal enters a state where it is difficult to transmit the light. On the other hand, the larger the positive polarity output gradation voltage OUT(P) or the negative polarity output gradation voltage OUT(N) is, the larger the intensity of the electric field which is applied to the liquid crystal is and the liquid crystal enters a state where it is easy to transmit the light. Therefore, even if the switching operation of the connection of the positive polarity feedback amplifier AMP(P) and the connection of the negative polarity feedback amplifier AMP(N) is executed between the two signal lines every predetermined elapse of time as mentioned above, a reproduced image is not influenced.

For example, a case where the positive polarity input gradation voltage DAC(P) and the negative polarity input gradation voltage DAC(N) which are line-symmetrical with respect to the intermediate voltage VM as a center are inputted to the positive polarity feedback amplifier AMP(P) and the negative polarity feedback amplifier AMP(N), respectively, will be described. Usually, since luminance levels of the adjacent dots are equal in many cases, such a state often occurs. FIGS. 5(*c*) and 5(*d*) show changes in each voltage in such a state.

FIG. 5(*c*) shows the time chart in the case where, for example, the positive polarity input gradation voltage DAC (P) which increases from VU1 to VU3 at time P1, decreases from VU3 to VU2 at time P2, and increases from VU2 to VU3 at time P5 is inputted to the positive polarity feedback amplifier AMP(P), respectively, and the negative polarity input gradation voltage DAC(N) which increases from VD1 to VD3 at time P1, decreases from VD3 to VD2 at time P2, and increases from VD2 to VD3 at time P5 is inputted to the negative polarity feedback amplifier AMP(N), respectively.

At this time, in the positive polarity feedback amplifier AMP(P), when the positive polarity input gradation voltage DAC(P) increases from VU1 to VU3 at time P1, the positive polarity output gradation voltage OUT(P) promptly traces VU3. However, when the positive polarity input gradation voltage DAC(P) decreases from VU3 to VU2 at time P2, although the positive polarity output gradation voltage OUT (P) is supposed to decrease to VU2 at time P3, it cannot trace such a voltage but decreases to reach VU2 at time P4. In the negative polarity feedback amplifier AMP(N), when the negative polarity input gradation voltage DAC(N) increases from VD1 to VD3 at time P1, the negative polarity output gradation voltage OUT(N) promptly traces VD3. However, when the negative polarity input gradation voltage DAC(N) decreases from VD3 to VD2 at time P2, although the negative polarity input gradation voltage OUT(N) is supposed to decrease to VD2 at time P3, it cannot trace such a voltage but decreases to reach VD2 at time P4.

Such a phenomenon is common to the voltage followers which are used as a positive polarity feedback amplifier AMP(P) and a negative polarity feedback amplifier AMP(N) to which a capacitive load is connected. That is, in the positive polarity feedback amplifier AMP(P), although the operation to increase the positive polarity output gradation voltage OUT(P) is fast, the operation to decrease the positive polarity output gradation voltage OUT(P) is slow. Such a fact is generally known. Also in the negative polarity feedback amplifier AMP(N), although the operation to increase the negative polarity output gradation voltage OUT(N) is fast, the operation to decrease the negative polarity output gradation voltage OUT(N) is slow. Such a fact is also generally known. In such a state, an image cannot be accurately reproduced onto a display screen of the liquid crystal display apparatus.

Therefore, when the switching operation of the connection of the positive polarity feedback amplifier AMP(P) and the connection of the negative polarity feedback amplifier AMP(N) is executed between the two signal lines at a predetermined time interval as mentioned above, the control switch SW3 is short-circuited, charges charged in the parasitic capacitors C1 and C2 are once returned to the intermediate voltage VM, and thereafter, the operation is started. A peripheral construction of the control switch SW3 will be described in detail hereinlater in the description of a preferred embodiment.

Meanwhile, constructions to prevent the occurrence of such a problem have also been laid open (for example, refer to JP-A-11-95729 (Page 5, FIG. 1) and JP-A-2002-229525 (Summary)).

The method whereby the control switch SW3 is short-circuited each time the connection switching of the positive polarity feedback amplifier AMP(P) and the negative polarity feedback amplifier AMP(N) is executed at a predetermined time interval, the charges charged in the parasitic capacitors C1 and C2 are once returned to the intermediate voltage VM, and thereafter, the operation is started as mentioned above, has the following problems to be solved. That is, when the connection switching is executed at a predetermined time interval, the operation is performed effectively. However, if a switching period becomes long, for example, twice as long as the predetermined time interval, three times as long as the predetermined time interval, . . . , a case where a signal level decreases in the same period occurs. In such a case, since the connection switching is not executed even if the signal level decreases, an inconvenience as mentioned above occurs. Therefore, the effect is small. This is because the voltages of the parasitic capacitors C1 and C2 are not returned to the intermediate voltage VM unless the connection switching is executed.

Even if the connection switching is executed at a predetermined time interval, when the luminance levels of the adjacent dots are different, such amounts of the charges charged in the parasitic capacitors C1 and C2 are not equal, so that the voltages are difficult to be returned to the intermediate voltage VM. Further, in the cases of JP-A-11-95729 and JP-A-2002-229525, since a circuit scale increases, there are problems to be solved such as increase in area of a chip and increase in costs.

SUMMARY OF THE INVENTION

It is, therefore, an object of the invention to realize a driving circuit for a liquid crystal display in which the foregoing problems are solved, costs are not increased, and a large effect is obtained.

According to the invention, to accomplish the above object, there is provided a driving circuit for a liquid crystal display, comprising:

a positive polarity operating circuit having a positive polarity feedback amplifier which receives an input voltage of a positive polarity which increases/decreases in a positive direction from a predetermined reference voltage and outputs a voltage of a value which is equal to the positive polarity input voltage to a signal line that is connected; and a negative polarity operating circuit having a negative polarity feedback amplifier which receives an input voltage of a negative polarity which increases/decreases in a negative direction from the predetermined reference voltage and outputs a voltage of a value which is equal to the negative polarity input voltage to a signal line that is connected, wherein a discharge accelerating unit which accelerates a discharge of a capacitive load of the signal line when the positive polarity input voltage decreases is provided for the positive polarity operating circuit, and a charge accelerating unit which accelerates a charge to a capacitive load of the signal line when the negative polarity input voltage decreases is provided for the negative polarity operating circuit.

Further, the driving circuit for a liquid crystal display may comprises:

a positive polarity input voltage increase/decrease detecting unit which, when it receives a control signal, feeds back a positive polarity voltage of the capacitive load to an input side of the positive polarity feedback amplifier for a predetermined time and compares the positive polarity voltage of the capacitive load with the positive polarity input voltage, thereby detecting the increase/decrease in the positive polarity input voltage; and a negative polarity input voltage increase/decrease detecting unit which, when it receives the control signal, feeds back a negative polarity voltage of the capacitive load to an input side of the negative polarity feedback amplifier for a predetermined time and compares the negative polarity voltage of the capacitive load with the negative polarity input voltage, thereby detecting the increase/decrease in an absolute value of the negative polarity input voltage.

In the driving circuit for a liquid crystal, the discharge accelerating unit comprises a p-type transistor, a gate of the p-type transistor receives the positive polarity output voltage of the positive polarity feedback amplifier, a drain of the p-type transistor receives the positive polarity voltage of the capacitive load, a source of the p-type transistor is maintained at the predetermined reference voltage, and when the positive polarity input voltage increase/decrease detecting unit detects the decrease in the positive polarity input voltage, the p-type transistor is turned on and allows the capacitive load to be discharged; and the charge accelerating unit comprises an n-type transistor, a gate of the n-type transistor receives the negative polarity output voltage of the negative polarity feedback amplifier, a drain of the n-type transistor receives the negative polarity voltage of the capacitive load, a source of the n-type transistor is maintained at the predetermined reference voltage, and when the negative polarity input voltage increase/decrease detecting unit detects the decrease in the negative polarity input voltage, the n-type transistor is turned on and allows the capacitive load to be charged.

Further, in the driving circuit for a liquid crystal display, the source of the p-type transistor and the source of the n-type transistor are mutually connected in a floating state so as to compensate the charge/discharge to/from the capacitive load.

The above and other objects and features of the present invention will become apparent from the following detailed description and the appended claims with reference to the accompanying drawings.

DETAILED DESCRIPTION OF THE PREFERRED EMBODIMENT

To solve the problem such that the operation to decrease the positive polarity output gradation voltage OUT(P) by the positive polarity feedback amplifier AMP(P) is slow, according to the invention, a discharge accelerating unit for accelerating a discharge of a capacitive load is provided for a positive polarity operating circuit. To solve the problem such that the operation to decrease the negative polarity output gradation voltage OUT(N) by the negative polarity feedback amplifier AMP(N) is slow, a charge accelerating unit for accelerating a charge of the capacitive load is provided for a negative polarity operating circuit. Further, a positive polarity input voltage increase/decrease detecting unit to detect the decrease in positive polarity output gradation voltage OUT(P) is provided for the positive polarity operating circuit. A negative polarity input voltage increase/decrease detecting unit to detect the decrease in negative polarity output gradation voltage OUT(N) is provided for the negative polarity operating circuit.

In this manner, good characteristics can be obtained irrespective of a switching period and luminance levels of adjacent dots. An embodiment to accomplish the above object will now be described hereinbelow.

The embodiment of the invention will be described hereinbelow.

Since a driving circuit for a liquid crystal display according to the invention is constructed by two main fundamental constructional portions, contents of each of the fundamental constructional portions will be first described and the whole construction and operation will be subsequently explained.

Figure 1A:
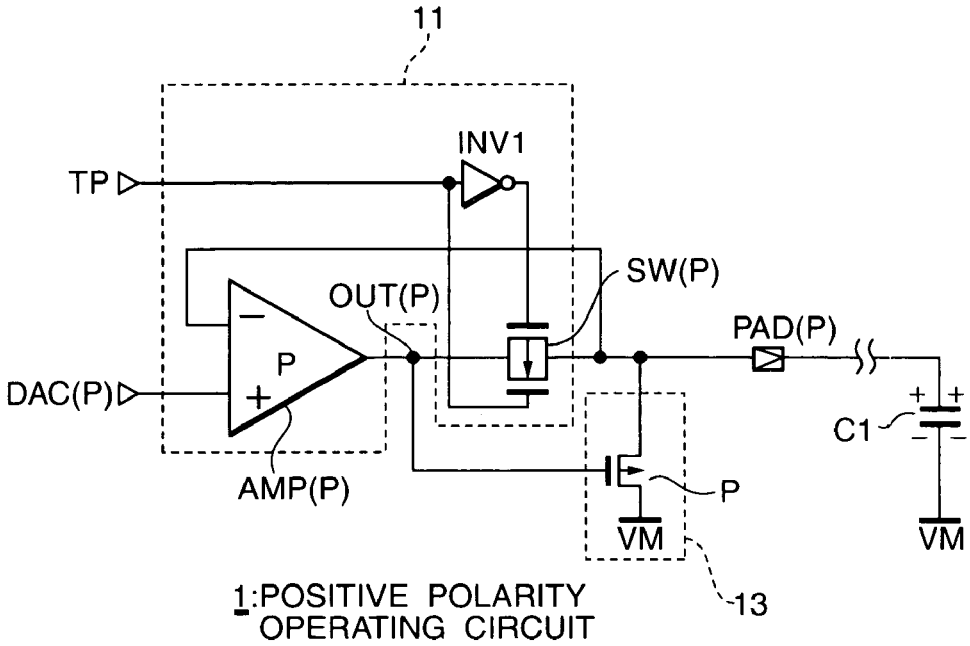
FIGS. 1A and 1B are block diagrams of fundamental constructional portions of the invention.
Figure 1B:
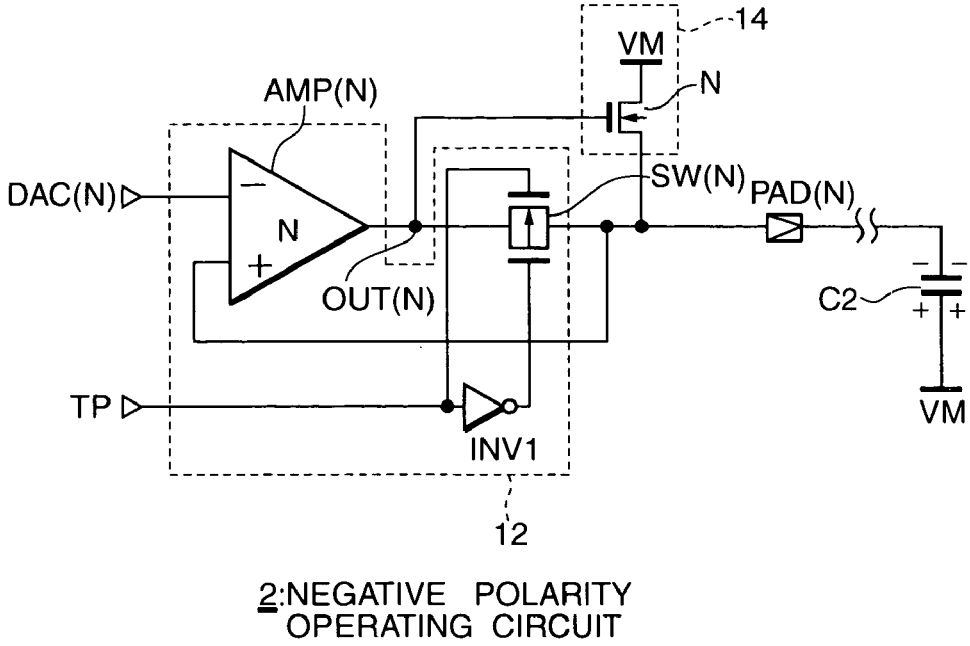

FIGS. 1A and 1B are block diagrams of the fundamental constructional portions of the invention.

FIG. 1A shows a circuit diagram of a positive polarity operating circuit and FIG. 1B shows a circuit diagram of a negative polarity operating circuit.

Referring to the diagrams, the driving circuit for the liquid crystal display according to the invention comprises a positive polarity operating circuit 1 and a negative polarity operating circuit 2.

The positive polarity operating circuit 1 is a portion which receives an input voltage of a positive polarity which increases/decreases in the positive direction from a predetermined reference voltage and outputs a voltage of a value which is equal to the positive polarity input voltage irrespective of magnitude of a connected capacitive load. Ordinarily, the predetermined voltage is set to a voltage of ½ of the power voltage VDD. Such a voltage is assumed to be the intermediate voltage VM hereinafter. The positive polarity input voltage is usually expressed as a positive polarity input gradation voltage DAC(P) according to luminance of an image.

That is, the positive polarity operating circuit 1 has the positive polarity feedback amplifier AMP(P). The positive polarity feedback amplifier AMP(P) is a feedback amplifier of a voltage follower type which receives the positive polarity input gradation voltage DAC(P) and outputs an output voltage which is equal to the positive polarity input gradation voltage DAC(P) irrespective of the magnitude of the parasitic capacitor C1 of the connected capacitive load. Such an output voltage is assumed to be the positive polarity output gradation voltage OUT(P) hereinbelow.

The positive polarity feedback amplifier AMP(P) receives the positive polarity input gradation voltage DAC(P) at a (+) node of the input side and feeds back the positive polarity output gradation voltage OUT(P) from its output node to a (−) node of the input side. The output node of the positive polarity feedback amplifier AMP(P) is connected to a pad PAD(P) coupled with the parasitic capacitor C1 of a signal line for the liquid crystal display via a positive polarity control switch SW(P).

The positive polarity control switch SW(P) is arranged between the output node of the positive polarity feedback amplifier AMP(P) and a feedback node for feeding back the positive polarity output gradation voltage OUT(P) to the (−) node of the input side. A positive polarity input voltage increase/decrease detecting unit 11 is constructed by the positive polarity control switch SW(P), an inverter INV1, and the positive polarity feedback amplifier AMP(P).

When the positive polarity input voltage increase/decrease detecting unit 11 receives a control signal TP, the detecting unit 11 turns off the positive polarity control switch SW(P) while the control signal TP is at the high level, feeds back a terminal voltage (positive polarity voltage) of the capacitive load (parasitic capacitor C1 here) to the (−) node of the input side of the positive polarity feedback amplifier AMP(P), and compares the terminal voltage with the positive polarity input gradation voltage DAC(P) which is inputted at that time, thereby detecting the increase or decrease in the positive polarity input gradation voltage DAC(P).

That is, when the positive polarity control switch SW(P) is OFF, if the positive polarity input gradation voltage DAC(P) is larger than the terminal voltage of the parasitic capacitor C1, the positive polarity output gradation voltage OUT(P) increases sharply to the power voltage VDD. If the positive polarity input gradation voltage DAC(P) is smaller than the terminal voltage of the parasitic capacitor C1, the positive polarity output gradation voltage OUT(P) decreases sharply to the intermediate voltage VM. The increase or decrease in an absolute value of the positive polarity input gradation voltage DAC(P) can be easily detected from such a voltage fluctuation.

A discharge accelerating unit 13 (transistor P) to accelerate the discharge of the capacitive load (parasitic capacitor C1) when the positive polarity input gradation voltage DAC(P) decreases is connected to the feedback node for feeding back the positive polarity output gradation voltage OUT(P) to the (−) node of the input side.

The discharge accelerating unit 13 comprises a p-type transistor. In order to turn off the positive polarity control switch SW(P) when the positive polarity output gradation voltage OUT(P) increases and to turn it on when the voltage OUT(P) decreases, a gate of the transistor P receives the positive polarity output gradation voltage OUT(P), a drain of the transistor P receives the terminal voltage of the parasitic capacitor C1, and a source of the transistor P is maintained at the intermediate voltage VM so that they stride over the positive polarity control switch SW(P).

The negative polarity operating circuit 2 is a portion which receives an input voltage of the negative polarity which increases/decreases in the negative direction from the predetermined reference voltage and outputs a voltage of a value which is equal to the negative polarity input voltage irrespective of the magnitude of the connected capacitive load. Ordinarily, the predetermined voltage here is set to the voltage of ½ of the power voltage VDD. Such a voltage is assumed to be the intermediate voltage RIM hereinafter. The negative polarity input voltage is usually expressed as a negative polarity input gradation voltage DAC(N) according to the luminance of the image.

That is, the negative polarity operating circuit 2 has the negative polarity feedback amplifier AMP(N). The negative polarity feedback amplifier AMP(N) is a feedback amplifier of a voltage follower type which receives the negative polarity input gradation voltage DAC(N) and outputs an output voltage which is equal to the negative polarity input gradation voltage DAC(N) irrespective of the magnitude of the parasitic capacitor C2 of the connected capacitive load. Such an output voltage is assumed to be the negative polarity output gradation voltage OUT(N) hereinbelow.

The negative polarity feedback amplifier AMP(N) receives the negative polarity input gradation voltage DAC (N) at the (+) node of the input side and feeds back the negative polarity output gradation voltage OUT(N) from its output node to the (−) node of the input side. The output node of the negative polarity feedback amplifier AMP(N) is connected to a pad PAD(N) coupled with the parasitic capacitor C2 of the signal line for the liquid crystal display via a negative polarity control switch SW(N).

The negative polarity control switch SW(N) is arranged between the output node of the negative polarity feedback amplifier AMP(N) and a feedback node for feeding back the negative polarity output gradation voltage OUT(N) to the (−) node of the input side. A negative polarity input voltage increase/decrease detecting unit 12 is constructed by the negative polarity control switch SW(N), the inverter INV1, and the negative polarity feedback amplifier AMP(N).

When the negative polarity input voltage increase/decrease detecting unit 12 receives the control signal TP, the detecting unit 12 turns off the negative polarity control switch SW(N) while the control signal TP is at the high level, feeds back a terminal voltage (negative polarity voltage) of the capacitive load (parasitic capacitor C2 here) to the negative polarity feedback amplifier AMP(N), and compares the terminal voltage with the negative polarity input gradation voltage DAC(N) which is inputted at that time, thereby detecting the increase or decrease in the negative polarity input gradation voltage DAC(N).

That is, when the negative polarity control switch SW(N) is OFF, if the negative polarity input gradation voltage DAC(N) is larger than the terminal voltage (negative polarity voltage) of the parasitic capacitor C2, the negative polarity output gradation voltage OUT(N) increases sharply to the ground voltage VSS. If the negative polarity input gradation voltage DAC(N) is smaller than the terminal voltage of the parasitic capacitor C2, the negative polarity output gradation voltage OUT(N) decreases sharply to the intermediate voltage VM. The increase or decrease in an absolute value of the negative polarity input gradation voltage DAC(N) can be easily detected from such a voltage fluctuation.

A charge accelerating unit 14 (transistor N) to accelerate a charge of the capacitive load (parasitic capacitor C2) when the negative polarity input gradation voltage DAC(N) decreases is connected to the feedback node for feeding back the negative polarity output gradation voltage OUT(N) to the (−) node of the input side.

The charge accelerating unit 14 comprises an n-type transistor. In order to turn off the negative polarity control switch SW(N) when the negative polarity output gradation voltage OUT(N) increases and to turn it on when the voltage OUT(N) decreases, a gate of the transistor N receives the negative polarity output gradation voltage OUT(N), a drain of the transistor N receives the terminal voltage of the parasitic capacitor C2, and a source of the transistor N is maintained at the intermediate voltage VM so that they stride over the negative polarity control switch SW(N).

Subsequently, the operation of the fundamental constructional portions will be explained.

Figure 2:
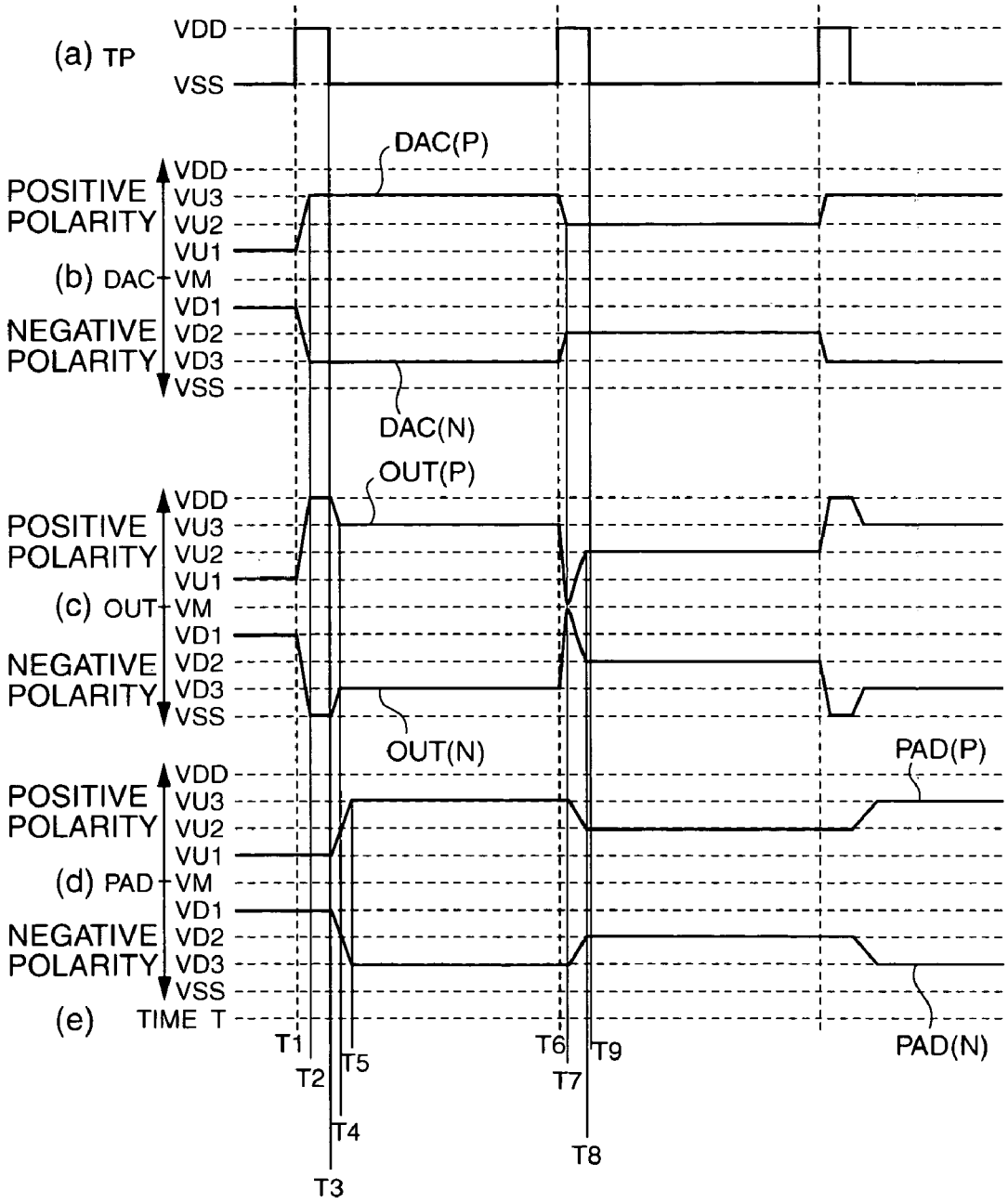
FIG. 2 is a time chart for the operations of the fundamental constructional portions.

FIG. 2 is a time chart for the operations of the fundamental constructional portions.

From the top of the diagram, (a) shows the control signal TP, (b) shows the positive polarity input gradation voltage DAC(P) and the negative polarity input gradation voltage DAC(N), (c) shows the positive polarity output gradation voltage OUT(P) and the negative polarity output gradation voltage OUT(N), (d) shows the positive polarity gradation voltage at the pad PAD(P) and the negative polarity gradation voltage at the pad PAD(N), and (e) shows time which is common to all of them in order. VDD denotes the power voltage; VSS the ground voltage; VM the intermediate voltage; VU1 to VU3 the positive polarity gradation voltage levels; and VD1 to VD3 the negative polarity gradation voltage levels, respectively.

Explanation will now be made in accordance with each time with reference to FIG. 2.

Time T1

The control signal TP changes to the high level. The positive polarity control switch SW(P) which has so far been in the ON state is turned off. The feedback voltage to the (−) node of the input side of the positive polarity feedback amplifier AMP(P) is switched from the positive polarity output gradation voltage OUT(P) to the positive polarity gradation voltage (voltage of the parasitic capacitor C1) of the pad PAD(P).

At this time, when the positive polarity input gradation voltage DAC(P) which has so far been maintained at VU1 starts to increase, the positive polarity feedback amplifier AMP(P) compares the positive polarity input gradation voltage DAC(P) with the positive polarity gradation voltage of the pad PAD(P), amplifies a difference between them, and outputs an amplified value. Since the positive polarity gradation voltage of the pad PAD(P) is maintained at VU1, the positive polarity output gradation voltage OUT(P) increases sharply and reaches the power voltage VDD. At this time, since the transistor P is held in the OFF state, the positive polarity gradation voltage of the pad PAD(P) continues to be maintained at VU1 as a voltage level which has so far been held.

Similarly, when the control signal TP changes to the high level, the negative polarity control switch SW(N) which has so far been in the ON state is also turned off. The feedback voltage to the (−) node of the input side of the negative polarity feedback amplifier AMP(N) is switched from the negative polarity output gradation voltage OUT(N) to the negative polarity gradation voltage of the pad PAD(N).

At this time, when the negative polarity input gradation voltage DAC(N) which has so far been maintained at VD1 starts to increase, the negative polarity feedback amplifier AMP(N) compares the negative polarity input gradation voltage DAC(N) with the negative polarity gradation voltage of the pad PAD(N), amplifies a difference between them, and outputs an amplified value. Since the negative polarity gradation voltage of the pad PAD(N) is maintained at VD1, the negative polarity output gradation voltage OUT(N) increases sharply and reaches the ground voltage VSS. At this time, since the transistor N is held in the OFF state, the voltage of the pad PAD(N) continues to be maintained at VD1 as a voltage level which has so far been held.

Time T2

When the positive polarity input gradation voltage DAC (P) reaches VU3, the positive polarity output gradation voltage OUT(P) reaches the power voltage VDD in association with it.

Similarly, when the negative polarity input gradation voltage DAC(N) reaches VD3, the negative polarity output gradation voltage OUT(N) reaches the ground voltage VSS in association with it. At this time, the positive polarity gradation voltage of the pad PAD(P) continues to be maintained at VU1 and the negative polarity gradation voltage of the pad PAD(N) also continues to be maintained at VD1.

Time T3

The control signal TP changes to the low level. The positive polarity control switch SW(P) which has so far been in the OFF state is turned on. The feedback voltage to the (−) node of the input side of the positive polarity feedback amplifier AMP(P) is switched from the positive polarity gradation voltage of the pad PAD(P) to the positive polarity output gradation voltage OUT(P). The positive polarity feedback amplifier AMP(P) starts the control operation that is inherent in the feedback amplifier for generating the output voltage which is equal to the positive polarity input gradation voltage DAC(P) irrespective of the magnitude of the parasitic capacitor C1 of the connected capacitive load.

Similarly, when the control signal TP changes to the low level, the negative polarity control switch SW(N) which has so far been in the OFF state is turned on. The feedback voltage to the (−) node of the input side of the negative polarity feedback amplifier AMP(N) is switched from the negative polarity gradation voltage of the pad PAD(N) to the negative polarity output gradation voltage OUT(N). The negative polarity feedback amplifier AMP(N) starts the control operation that is inherent in the feedback amplifier for generating the output voltage which is equal to the negative polarity input gradation voltage DAC(N) irrespective of the magnitude of the parasitic capacitor C2 of the connected capacitive load.

Time T4

By the feedback control of the positive polarity feedback amplifier AMP(P), the positive polarity output gradation voltage OUT(P) becomes equal to the value VU3 obtained after the change in the positive polarity input gradation voltage DAC(P). Similarly, by the feedback control of the negative polarity feedback amplifier AMP(N), the negative polarity output gradation voltage OUT(N) becomes equal to the value VD3 obtained after the change in the negative polarity input gradation voltage DAC(N).

Time T5

The positive polarity gradation voltage of the pad PAD(P) becomes equal to the value VU3 obtained after the change in the positive polarity input gradation voltage DAC(P) at timing which is slightly later than that of the positive polarity output gradation voltage OUT(P). It is now considered that a potential difference between the positive polarity gradation voltage of the pad PAD(P) and the positive polarity output gradation voltage OUT(P) during a period of time from time T3 to time T5 has transiently been absorbed by a conductive resistance of the positive polarity control switch SW(P), a floating capacitance of the line which reaches the pad PAD(P), and the like.

Similarly, the negative polarity gradation voltage of the pad PAD(N) becomes equal to the value VD3 obtained after the change in the negative polarity input gradation voltage DAC(N) at timing which is slightly later than that of the negative polarity output gradation voltage OUT(N). It is now considered that a potential difference between the negative polarity gradation voltage of the pad PAD(N) and the negative polarity output gradation voltage OUT(N) during the period of time from time T3 to time T5 has transiently been absorbed by a conductive resistance of the negative polarity control switch SW(N), a floating capacitance of the line which reaches the pad PAD(N), and the like.

Time T6

The control signal TP changes to the high level. The positive polarity control switch SW(P) which has so far been in the ON state is turned off. The feedback voltage to the (−) node of the input side of the positive polarity feedback amplifier AMP(P) is switched from the positive polarity output gradation voltage OUT(P) to the positive polarity gradation voltage of the pad PAD(P).

At this time, when the positive polarity input gradation voltage DAC(P) which has so far been maintained at VU3 starts to decrease, the positive polarity feedback amplifier AMP(P) compares the positive polarity input gradation voltage DAC(P) with the positive polarity gradation voltage of the pad PAD(P), amplifies a difference between them, and outputs an amplified value. Since the positive polarity input gradation voltage DAC(P) is smaller than the positive polarity gradation voltage of the pad PAD(P) here, the positive polarity output gradation voltage OUT(P) starts to decrease sharply. At the same time, since the transistor P is turned on, the positive polarity gradation voltage of the pad PAD(P) also starts to decrease.

Similarly, when the control signal TP changes to the high level, the negative polarity control switch SW(N) which has so far been in the ON state is also turned off. The feedback voltage to the (−) node of the input side of the negative polarity feedback amplifier AMP(N) is switched from the negative polarity output gradation voltage OUT(N) to the negative polarity gradation voltage of the pad PAD(N).

At this time, when the negative polarity input gradation voltage DAC(N) which has so far been maintained at VD3 starts to decrease, the negative polarity feedback amplifier AMP(N) compares the negative polarity input gradation voltage DAC(N) with the negative polarity gradation voltage of the pad PAD(N), amplifies a difference between them, and outputs an amplified value. Since the negative polarity input gradation voltage DAC(N) is smaller than the negative polarity gradation voltage of the pad PAD(N), the negative polarity output gradation voltage OUT(N) starts to decrease sharply. At the same time, since the transistor N is turned on, the negative polarity gradation voltage of the pad PAD(N) also starts to decrease.

Time T7

When the positive polarity input gradation voltage DAC (P) reaches VU2, the positive polarity output gradation voltage OUT(P) reaches the intermediate voltage VM in association with it. At this time, since the transistor P is ON, the positive polarity gradation voltage of the pad PAD(P) also continues to decrease.

Similarly, when the negative polarity input gradation voltage DAC(N) reaches VD2, the negative polarity output gradation voltage OUT(N) reaches the intermediate voltage VM in association with it. At this time, since the transistor N is ON, the negative polarity gradation voltage of the pad PAD(N) also continues to decrease.

Time T8

The positive polarity gradation voltage of the pad PAD(P) becomes equal to VU2 at this time, the difference between the positive polarity input gradation voltage DAC(P) and the positive polarity gradation voltage of the pad PAD(P)

becomes equal to 0, and the positive polarity output gradation voltage OUT(P) is equal to the positive polarity input gradation voltage DAC(P). Therefore, the transistor P is turned off. Thus, the decrease in voltage at the pad PAD(P) is also stopped.

Similarly, the negative polarity gradation voltage of the pad PAD(N) becomes equal to VD2 at this time, the difference between the negative polarity input gradation voltage DAC(N) and the negative polarity gradation voltage of the pad PAD(N) becomes equal to 0, and the negative polarity output gradation voltage OUT(N) is equal to the negative polarity input gradation voltage DAC(N). Therefore, the transistor N is turned off. Thus, the decrease in voltage at the pad PAD(N) is also stopped.

Time T9

The control signal TP changes to the low level. The positive polarity control switch SW(P) which has so far been in the OFF state is turned on. The feedback voltage to the (−) node of the input side of the positive polarity feedback amplifier AMP(P) is switched from the positive polarity gradation voltage of the pad PAD(P) to the positive polarity output gradation voltage OUT(P). The positive polarity feedback amplifier AMP(P) starts the control operation that is inherent in the feedback amplifier for generating the output voltage which is equal to the positive polarity input gradation voltage DAC(P) irrespective of the magnitude of the parasitic capacitor C1 of the connected capacitive load.

Similarly, when the control signal TP changes to the low level, the negative polarity control switch SW(N) which has so far been in the OFF state is turned on. The feedback voltage to the (−) node of the input side of the negative polarity feedback amplifier AMP(N) is switched from the negative polarity gradation voltage of the pad PAD(N) to the negative polarity output gradation voltage OUT(N). The negative polarity feedback amplifier AMP(N) starts the control operation that is inherent in the feedback amplifier for generating the output voltage which is equal to the negative polarity input gradation voltage DAC(N) irrespective of the magnitude of the parasitic capacitor C2 of the connected capacitive load.

The operation similar to that mentioned above is repeated hereinafter.

The following points should be noted in the above description of the operation.

Note 1

In the positive polarity operating circuit 1, if the voltage changes in the direction in which the positive polarity input gradation voltage DAC(P) decreases, when the control signal TP is at the high level, the transistor P (discharge accelerating unit 13) temporarily emits (discharges) the plus charges charged in the parasitic capacitor C1 of a signal line or the like.

Similarly, in the negative polarity operating circuit 2, if the voltage changes in the direction in which the negative polarity input gradation voltage DAC(N) decreases, when the control signal TP is at the high level, the transistor N (charge accelerating unit 14) temporarily emits (charges) the minus charges charged in the parasitic capacitor C2 of a signal line or the like.

Note 2

The positive polarity operating circuit 1 has the positive polarity control switch SW(P), changes the feedback voltage of the positive polarity feedback amplifier AMP(P) from the positive polarity output gradation voltage OUT(P) to the positive polarity gradation voltage of the pad PAD(P) while the control signal TP is at the high level, and compares the positive polarity gradation voltage of the pad PAD(P) with the positive polarity input gradation voltage DAC(P). When the absolute value of the positive polarity input gradation voltage DAC(P) is smaller than the positive polarity gradation voltage of the pad PAD(P), since the positive polarity output gradation voltage OUT(P) decreases sharply, the transistor P (discharge accelerating unit 13) is turned on.

Similarly, the negative polarity operating circuit 2 has the negative polarity control switch SW(N), changes the feedback voltage of the negative polarity feedback amplifier AMP(N) from the negative polarity output gradation voltage OUT(N) to the negative polarity gradation voltage of the pad PAD(N) while the control signal TP is at the high level, and compares the negative polarity gradation voltage of the pad PAD(N) with the negative polarity input gradation voltage DAC(N). When the absolute value of the negative polarity input gradation voltage DAC(N) is smaller than the absolute value of the negative polarity gradation voltage of the pad PAD(N), since the negative polarity output gradation voltage OUT(N) decreases sharply, the transistor N (charge accelerating unit 14) is turned on.

The description of the contents of the fundamental constructional portions of the driving circuit for the liquid crystal display according to the invention is finished here. Subsequently, the whole construction of the driving circuit for the liquid crystal display according to the invention and its operation will be described.

Figure 3:
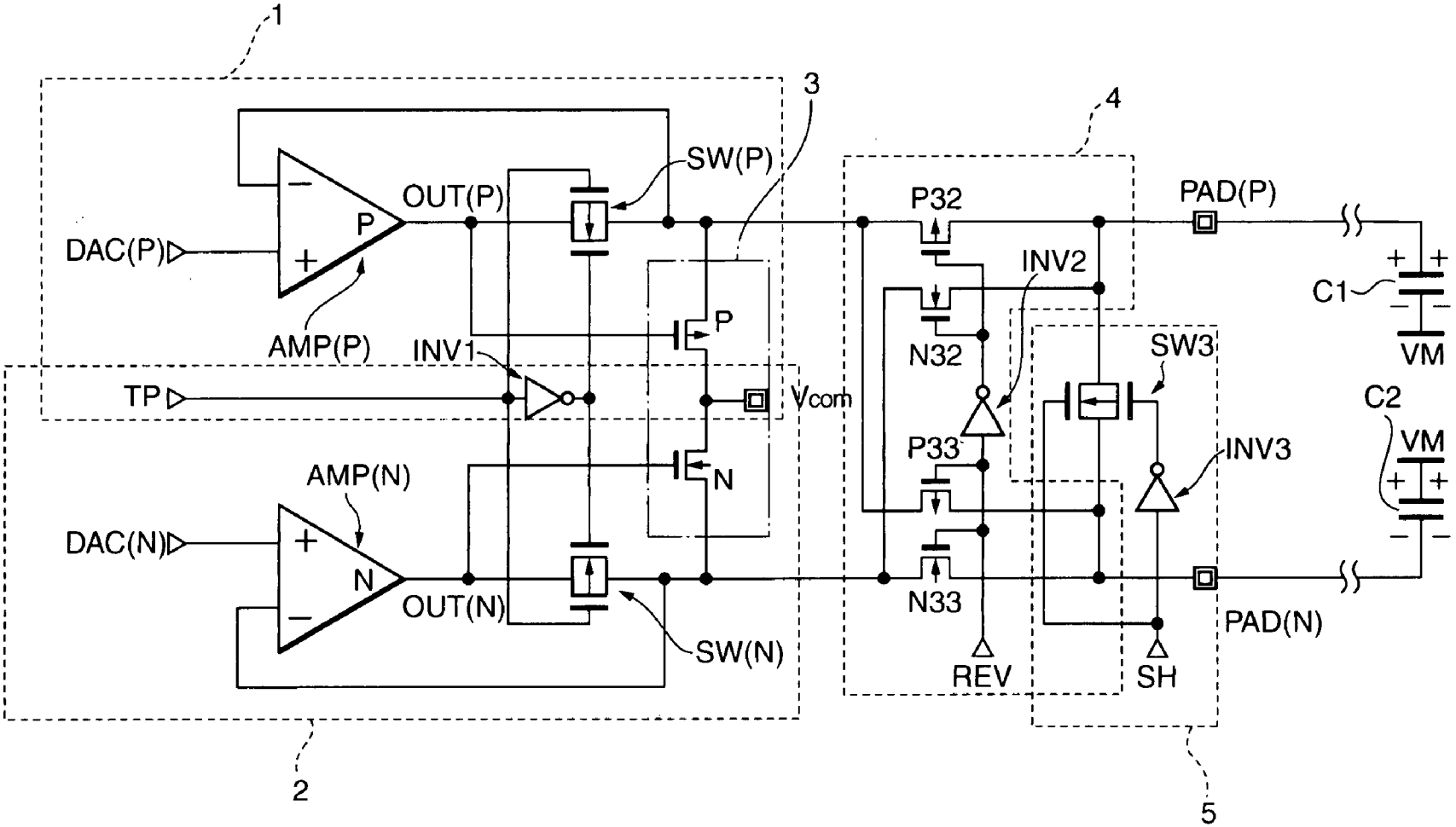
FIG. 3 is a block diagram of a construction of the invention.

FIG. 3 is a block diagram of a construction of the invention.

Referring to FIG. 3, the driving circuit for the liquid crystal display according to the invention comprises: the positive polarity operating circuit 1; the negative polarity operating circuit 2; a charge/discharge set-off unit 3; a signal line switching unit 4; and an intermediate potential forming unit 5.

As already described above, the positive polarity operating circuit 1 is a portion for receiving the positive polarity input gradation voltage DAC(P) which increases/decreases in the positive direction from the intermediate voltage VM and outputting the positive polarity output gradation voltage OUT(P) of the value which is equal to the positive polarity input gradation voltage DAC(P) irrespective of the magnitude of the capacitive load of the signal line which is connected. The intermediate voltage VM is generally set to the voltage of ½ of the power voltage VDD as mentioned above. The positive polarity input gradation voltage DAC(P) is ordinarily a gradation voltage according to the luminance of the image.

As already described above, the negative polarity operating circuit 2 is a portion for receiving the negative polarity input gradation voltage DAC(N) which increases/decreases in the negative direction from the intermediate voltage VM and outputting the negative polarity output gradation voltage OUT(N) of the value which is equal to the negative polarity input gradation voltage DAC(N) irrespective of the magnitude of the capacitive load of the signal line which is connected. The intermediate voltage VM is generally set to the voltage of ½ of the power voltage VDD as mentioned above. The negative polarity input gradation voltage DAC (N) is ordinarily a gradation voltage according to the luminance of the image.

The charge/discharge set-off unit 3 is a portion for mutually connecting the source of the p-type transistor and the source of the n-type transistor in a floating state so as to compensate the charge/discharge to/from the capacitive load of the signal line which is connected. By constructing as mentioned above, the charge/discharge which are executed via the transistor P of the positive polarity operating circuit 1 and the charge/discharge which are executed via the transistor N of the negative polarity operating circuit 2 are mutually compensated, thereby reducing current consumption as a whole circuit.

The signal line switching unit 4 is a portion for executing the connection switching of the positive polarity operating circuit 1 and the negative polarity operating circuit 2 between two signal lines every predetermined duration. When a reverse signal REV in the diagram is at the low level, a transistor P33 and a transistor N32 which are connected to both ends of an inverter INV2 are turned on. An output of the positive polarity operating circuit 1 is supplied to the pad PAD(N) and an output of the negative polarity operating circuit 2 is supplied to the pad PAD(P), respectively. At this time, a transistor P32 and a transistor N33 are OFF.

Similarly, in the signal line switching unit 4, when the reverse signal REV in the diagram is at the high level, the transistor P32 and the transistor N33 connected to both ends of the inverter INV2 are turned on. The output of the positive polarity operating circuit 1 is supplied to the pad PAD(P) and the output of the negative polarity operating circuit 2 is supplied to the pad PAD(N), respectively. At this time, the transistor P33 and the transistor N32 are OFF.

The intermediate potential forming unit 5 is a portion for short-circuiting the control switch SW3 when the connection switching of the positive polarity operating circuit 1 and the negative polarity operating circuit 2 is executed between two signal lines every predetermined duration and once returning the charges charged in the parasitic capacitors C1 and C2 of the signal lines to the intermediate voltage VM.

When a precharge signal SH in the diagram is changed to the high level, the switch SW3 is turned on, a loop along the switch SW3→pad PAD(P)→parasitic capacitor C1→parasitic capacitor C2→pad PAD(N)→switch SW3 is constructed. The charges accumulated in the parasitic capacitors C1 and C2 are once discharged. A common connecting point of the parasitic capacitors C1 and C2 is held at the intermediate voltage VM.

Subsequently, the operation of the driving circuit for the liquid crystal display according to the invention will be described.

Figure 4:
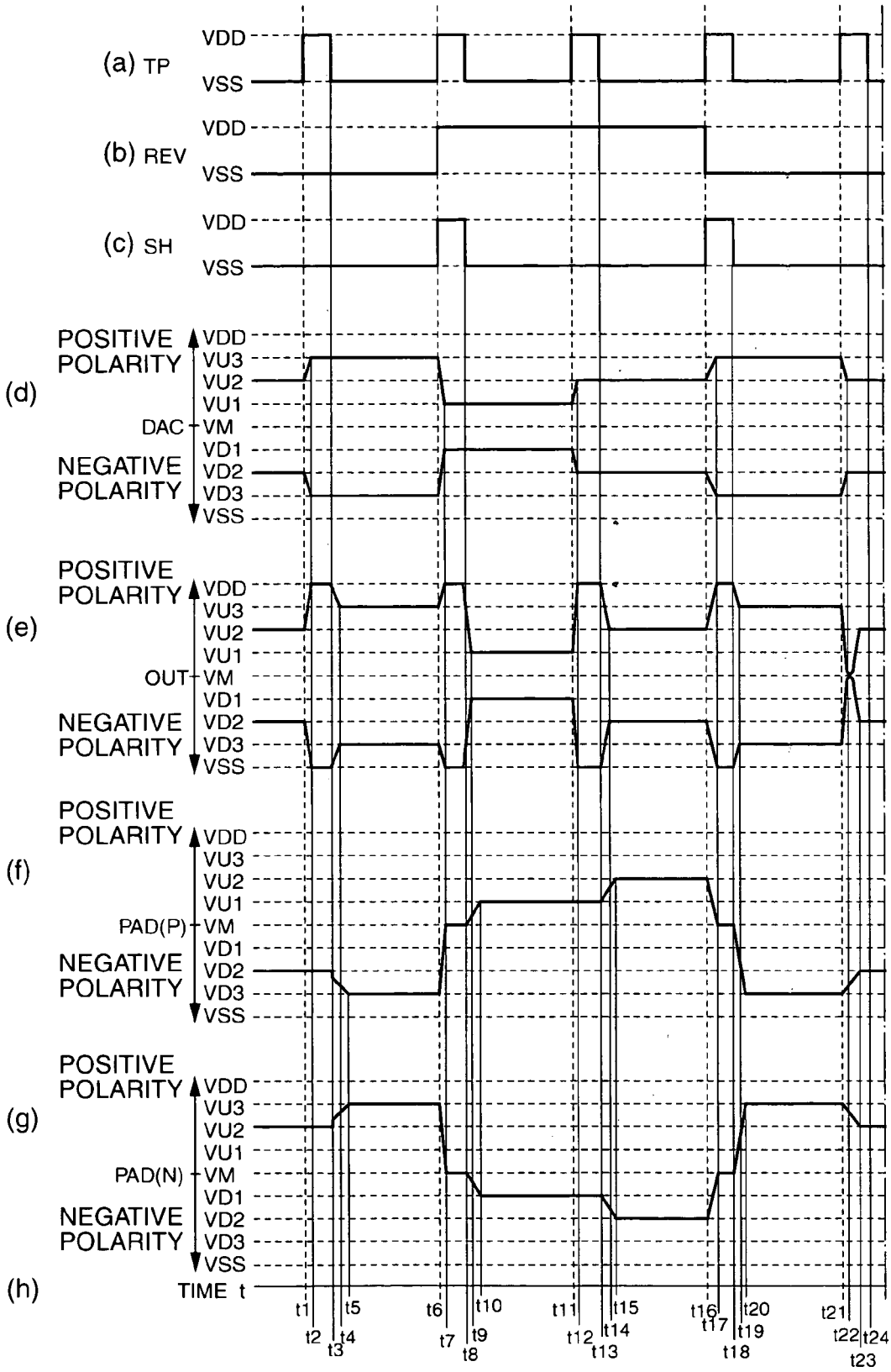
FIG. 4 is a time chart for the operation of a liquid crystal driving circuit according to the invention.
Figure 5:
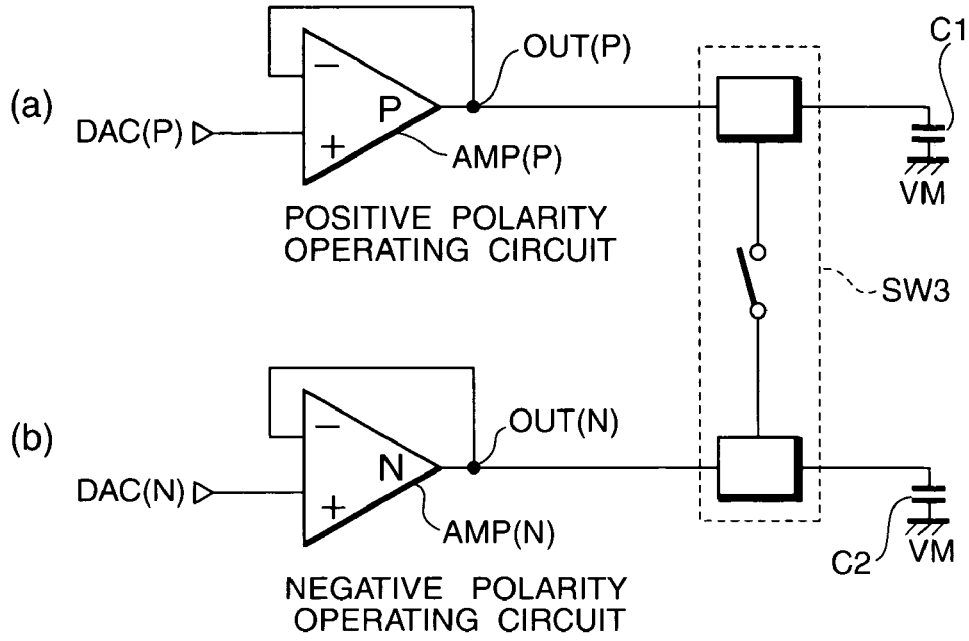
FIG. 5 is a circuit diagram of a conventional liquid crystal driving circuit.
Figure 5:
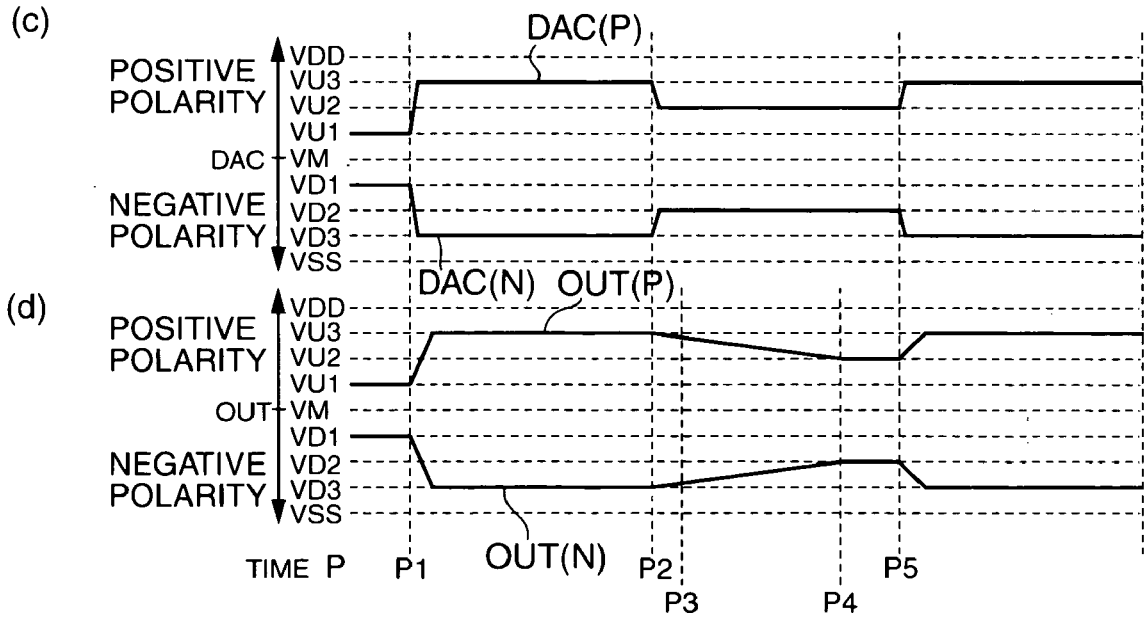

FIG. 4 is a time chart for the operation of the liquid crystal driving circuit according to the invention.

From the top of FIG. 4, (a) shows the control signal TP, (b) shows the reverse signal REV, (c) shows the precharge signal SH, (d) shows the positive polarity input gradation voltage DAC(P) and the negative polarity input gradation voltage DAC(N), (e) shows the positive polarity output gradation voltage OUT(P) and the negative polarity output gradation voltage OUT(N), (f) shows the positive and negative polarity gradation voltages at the pad PAD(P), (g) shows the negative and positive polarity gradation voltages at the pad PAD(N), and (h) shows time which is common to all of them in order. VDD denotes the power voltage; VSS the ground voltage; VM the intermediate voltage; VU1 to VU3 the positive polarity gradation voltage levels; and VD1 to VD3 the negative polarity gradation voltage levels, respectively.

Explanation will now be made with reference to FIG. 3 in accordance with each time.

Time t1

The control signal TP changes to the high level. The positive polarity control switch SW(P) which has so far been in the ON state is turned off. The feedback voltage to the (−) node of the input side of the positive polarity feedback amplifier AMP(P) is switched from the positive polarity output gradation voltage OUT(P) to the positive polarity gradation voltage of the pad PAD(N). This is because since the reverse signal REV is at the low level, the positive polarity operating circuit 1 is connected to the pad PAD(N) and the negative polarity operating circuit 2 is connected to the pad PAD(P).

At this time, when the absolute value of the positive polarity input gradation voltage DAC(P) which has so far been maintained at VU2 starts to increase, the positive polarity feedback amplifier AMP(P) compares the positive polarity input gradation voltage DAC(P) with the positive polarity gradation voltage of the pad PAD(N), amplifies a difference between them, and outputs an amplified value. Since the voltage of the pad PAD(N) is maintained at VU2, an absolute value of the positive polarity output gradation voltage OUT(P) increases sharply and reaches the power voltage VDD. At this time, since the transistor P is held in the OFF state, the positive polarity gradation voltage of the pad PAD(N) continues to be maintained at VU2 as a voltage level which has so far been held.

Similarly, when the control signal TP changes to the high level, the negative polarity control switch SW(N) which has so far been in the ON state is also turned off. The feedback voltage to the (−) node of the input side of the negative polarity feedback amplifier AMP(N) is switched from the negative polarity output gradation voltage OUT(N) to the negative polarity gradation voltage of the pad PAD(P).

At this time, when the negative polarity input gradation voltage DAC(N) which has so far been maintained at VD2 starts to increase, the negative polarity feedback amplifier AMP(N) compares the negative polarity input gradation voltage DAC(N) with the negative polarity gradation voltage of the pad PAD(P), amplifies a difference between them, and outputs an amplified value. Since the negative polarity gradation voltage of the pad PAD(P) is maintained at VD2, the negative polarity output gradation voltage OUT(N) increases sharply and reaches the ground voltage VSS. At this time, since the transistor N of the charge/discharge set-off unit 3 is held in the OFF state, the negative polarity gradation voltage of the pad PAD(P) continues to be maintained at VD2 as a voltage level which has so far been held.

Time t2

When the positive polarity input gradation voltage DAC (P) reaches VU3, the positive polarity output gradation voltage OUT(P) reaches the power voltage VDD in association with it.

Similarly, when the negative polarity input gradation voltage DAC(N) reaches VD3, the negative polarity output gradation voltage OUT(N) reaches the ground voltage VSS in association with it. At this time, the voltage of the pad PAD(N) continues to be maintained at VU2 and the voltage of the pad PAD(P) also continues to be maintained at VD2.

Time t3

The control signal TP changes to the low level. The positive polarity control switch SW(P) which has so far been in the OFF state is turned on. The feedback voltage to the (−) node of the input side of the positive polarity feedback amplifier AMP(P) is switched from the positive polarity gradation voltage of the pad PAD(N) to the positive polarity output gradation voltage OUT(P). The positive polarity feedback amplifier AMP(P) starts the control operation that is inherent in the feedback amplifier for generating the output voltage which is equal to the positive polarity input gradation voltage DAC(P) irrespective of the magnitude of the parasitic capacitance of the connected capacitive load.

Similarly, when the control signal TP changes to the low level, the negative polarity control switch SW(N) which has so far been in the OFF state is turned on. The feedback voltage to the (−) node of the input side of the negative polarity feedback amplifier AMP(N) is switched from the negative polarity gradation voltage of the pad PAD(P) to the negative polarity output gradation voltage OUT(N). The negative polarity feedback amplifier AMP(N) starts the control operation that is inherent in the feedback amplifier for generating the output voltage which is equal to the positive polarity input gradation voltage DAC(P) irrespective of the magnitude of the parasitic capacitance of the connected capacitive load.

Time t4

By the feedback control of the positive polarity feedback amplifier AMP(P) the positive polarity output gradation voltage OUT(P) becomes equal to the value VU3 obtained after the change in the positive polarity input gradation voltage DAC(P). Similarly, by the feedback control of the negative polarity feedback amplifier AMP(N), the negative polarity output gradation voltage OUT(N) becomes equal to the value VD3 obtained after the change in the negative polarity input gradation voltage DAC(N).

Time t5

The positive polarity gradation voltage of the pad PAD(N) becomes equal to the value VU3 obtained after the change in the positive polarity input gradation voltage DAC(P) at timing which is slightly later than that of the positive polarity output gradation voltage OUT(P). It is now considered that a potential difference between the positive polarity gradation voltage of the pad PAD(N) and the positive polarity output gradation voltage OUT(P) during a period of time from time t3 to time t5 has transiently been absorbed by the conductive resistance of the positive polarity control switch SW(P), the floating capacitance of the line which reaches the pad PAD(N), and the like.

Similarly, the negative polarity gradation voltage of the pad PAD(P) becomes equal to the value VD3 obtained after the change in the negative polarity input gradation voltage DAC(N) at timing which is slightly later than that of the negative polarity output gradation voltage OUT(N). It is now considered that a potential difference between the negative polarity gradation voltage of the pad PAD(P) and the negative polarity output gradation voltage OUT(N) during the period of time from time t3 to time t5 has transiently been absorbed by the conductive resistance of the negative polarity control switch SW(N), the floating capacitance of the line which reaches the pad PAD(P), and the like.

Time t6

The control signal TP changes to the high level. The positive polarity control switch SW(P) which has so far been in the ON state is turned off. The feedback voltage to the (−) node of the input side of the positive polarity feedback amplifier AMP(P) is switched from the positive polarity output gradation voltage OUT(P) to the negative polarity gradation voltage of the pad PAD(P). This is because since the reverse signal REV has been changed to the high level, the positive polarity operating circuit 1 is connected to the pad PAD(P) and the negative polarity operating circuit 2 is connected to the pad PAD(N). At this time, since the precharge signal SH is changed to the high level, the negative polarity gradation voltage of the pad PAD(P) temporarily starts to decrease toward the intermediate voltage VM.

At this time, when the positive polarity input gradation voltage DAC(P) which has so far been maintained at VU3 starts to decrease, the positive polarity feedback amplifier AMP(P) compares the positive polarity input gradation voltage DAC(P) with the positive polarity gradation voltage of the pad PAD(P), amplifies a difference between them, and outputs an amplified value. Since the positive polarity gradation voltage of the pad PAD(P) is changing toward the intermediate voltage VM, the positive polarity output gradation voltage OUT(P) starts to increase sharply toward the power voltage VDD.

Similarly, when the control signal TP changes to the high level, the negative polarity control switch SW(N) which has so far been in the ON state is also turned off. The feedback voltage to the (−) node of the input side of the negative polarity feedback amplifier AMP(N) is switched from the negative polarity output gradation voltage OUT(N) to the positive polarity gradation voltage of the pad PAD(N). This is because since the reverse signal REV has been changed to the high level, the positive polarity operating circuit 1 is connected to the pad PAD(P) and the negative polarity operating circuit 2 is connected to the pad PAD(N). At this time, since the precharge signal SH is changed to the high level, the positive polarity gradation voltage of the pad PAD(N) temporarily starts to decrease toward the intermediate voltage VM.

At this time, when the negative polarity input gradation voltage DAC(N) which has so far been maintained at VD3 starts to decrease, the negative polarity feedback amplifier AMP(N) compares the negative polarity input gradation voltage DAC(N) with the negative polarity gradation voltage of the pad PAD(N), amplifies a difference between them, and outputs an amplified value. Since the negative polarity gradation voltage of the pad PAD(N) is changing toward the intermediate voltage VM, the positive polarity output gradation voltage OUT(P) increases sharply toward the power voltage VDD.

Time t7

When the positive polarity input gradation voltage DAC (P) reaches VU1, the positive polarity output gradation voltage OUT(P) also reaches the power voltage VDD in association with it. At this time, the negative polarity gradation voltage of the pad PAD(P) is temporarily returned to the intermediate voltage VM.

Similarly, when the negative polarity input gradation voltage DAC(N) reaches VD1, the negative polarity output gradation voltage OUT(N) also reaches the ground voltage VSS in association with it. At this time, the positive polarity gradation voltage of the pad PAD(N) is temporarily returned to the intermediate voltage VM.

Time t8

The control signal TP changes to the low level. The positive polarity control switch SW(P) which has so far been in the OFF state is turned on. The feedback voltage to the (−) node of the input side of the positive polarity feedback amplifier AMP(P) is switched from the intermediate voltage VM of the pad PAD(P) to the positive polarity output gradation voltage OUT(P). The positive polarity feedback amplifier AMP(P) starts the control operation that is inherent in the feedback amplifier for generating the output voltage which is equal to the positive polarity input gradation voltage DAC(P) irrespective of the magnitude of the parasitic capacitance of the connected capacitive load.

Similarly, when the control signal TP changes to the low level, the negative polarity control switch SW(N) which has so far been in the OFF state is turned on. The feedback voltage to the (−) node of the input side of the negative polarity feedback amplifier AMP(N) is switched from the intermediate voltage VM of the pad PAD(N) to the negative polarity output gradation voltage OUT(N). The negative polarity feedback amplifier AMP(N) starts the control operation that is inherent in the feedback amplifier for generating the output voltage which is equal to the negative polarity input gradation voltage DAC(N) irrespective of the magnitude of the parasitic capacitance of the connected capacitive load.

Time t9

By the feedback control of the positive polarity feedback amplifier AMP(P), the positive polarity output gradation voltage OUT(P) becomes equal to the value VU1 obtained after the change in the positive polarity input gradation voltage DAC(P). Similarly, by the feedback control of the negative polarity feedback amplifier AMP(N), the negative polarity output gradation voltage OUT(N) becomes equal to the value VD1 obtained after the change in the negative polarity input gradation voltage DAC(N).

Time t10

The positive polarity gradation voltage of the pad PAD(P) becomes equal to the value VU1 obtained after the change in the positive polarity input gradation voltage DAC(P) at timing which is slightly later than that of the positive polarity output gradation voltage OUT(P). It is now considered that a potential difference between the positive polarity gradation voltage of the pad PAD(P) and the positive polarity output gradation voltage OUT(P) during a period of time from time t8 to time t10 has transiently been absorbed by the conductive resistance of the positive polarity control switch SW(P), the floating capacitance of the line which reaches the pad PAD(P), and the like.

Similarly, the voltage of the pad PAD(N) becomes equal to the value VD1 obtained after the change in the negative polarity input gradation voltage DAC(N) at timing which is slightly later than that of the negative polarity output gradation voltage OUT(N). It is now considered that a potential difference between the negative polarity gradation voltage of the pad PAD(N) and the negative polarity output gradation voltage OUT(N) during the period of time from time t8 to time t10 has transiently been absorbed by the conductive resistance of the negative polarity control switch SW(N), the floating capacitance of the line which reaches the pad PAD(N), and the like.

Time t11

The control signal TP changes to the high level. The positive polarity control switch SW(P) which has so far been in the ON state is turned off. The feedback voltage to the (−) node of the input side of the positive polarity feedback amplifier AMP(P) is switched from the positive polarity output gradation voltage OUT(P) to the positive polarity gradation voltage of the pad PAD(P).

At this time, when the positive polarity input gradation voltage DAC(P) which has so far been maintained at VU1 starts to increase, the positive polarity feedback amplifier AMP(P) compares the positive polarity input gradation voltage DAC(P) with the voltage of the pad PAD(P), amplifies a difference between them, and outputs an amplified value. Since the voltage of the pad PAD(P) is maintained at VU1, the positive polarity output gradation voltage OUT(P) increases sharply toward the power voltage VDD. At this time, since the transistor P is held in the OFF state, the voltage of the pad PAD(P) continues to be maintained at VU1 which has so far been held.

Similarly, when the control signal TP changes to the high level, the negative polarity control switch SW(N) which has so far been in the ON state is also turned off. The feedback voltage to the (−) node of the input side of the negative polarity feedback amplifier AMP(N) is switched from the negative polarity output gradation voltage OUT(N) to the negative polarity gradation voltage of the pad PAD(N).

At this time, when the negative polarity input gradation voltage DAC(N) which has so far been maintained at VD1 starts to increase, the negative polarity feedback amplifier AMP(N) compares the negative polarity input gradation voltage DAC(N) with the negative polarity gradation voltage of the pad PAD(N), amplifies a difference between them, and outputs an amplified value. Since the negative polarity gradation voltage of the pad PAD(N) is maintained at VD1, the negative polarity output gradation voltage OUT(N) increases sharply toward the ground voltage VSS. At this time, since the transistor N is held in the OFF state, the voltage of the pad PAD(N) continues to be maintained at VD1 which has so far been held.

Time t12

When the positive polarity input gradation voltage DAC (P) reaches VU2, the positive polarity output gradation voltage OUT(P) reaches the power voltage VDD in association with it.

Similarly, when the negative polarity input gradation voltage DAC(N) reaches VD2, the negative polarity output gradation voltage OUT(N) reaches the ground voltage VSS in association with it. At this time, the voltage of the pad PAD(P) continues to be maintained at VU1 and the voltage of the pad PAD(N) also continues to be maintained at VD1.

Time t13

The control signal TP changes to the low level. The positive polarity control switch SW(P) which has so far been in the OFF state is turned on. The feedback voltage to the (−) node of the input side of the positive polarity feedback amplifier AMP(P) is switched from the positive polarity voltage of the pad PAD(P) to the positive polarity output gradation voltage OUT(P). The positive polarity feedback amplifier AMP(P) starts the control operation that is inherent in the feedback amplifier for generating the output voltage which is equal to the positive polarity input gradation voltage DAC(P) irrespective of the magnitude of the parasitic capacitance of the connected capacitive load.

Similarly, when the control signal TP changes to the low level, the negative polarity control switch SW(N) which has so far been in the OFF state is turned on. The feedback voltage to the (−) node of the input side of the negative polarity feedback amplifier AMP(N) is switched from the negative polarity voltage of the pad PAD(N) to the negative polarity output gradation voltage OUT(N). The negative polarity feedback amplifier AMP(N) starts the control operation that is inherent in the feedback amplifier for generating the output voltage which is equal to the negative polarity input gradation voltage DAC(N) irrespective of the magnitude of the parasitic capacitance of the connected capacitive load.

Time t14

By the feedback control of the positive polarity feedback amplifier AMP(P), the positive polarity output gradation voltage OUT(P) becomes equal to the value VU2 obtained after the change in the positive polarity input gradation voltage DAC(P). Similarly, by the feedback control of the negative polarity feedback amplifier AMP(N), the negative polarity output gradation voltage OUT(N) becomes equal to the value VD2 obtained after the change in the negative polarity input gradation voltage DAC(N).

Time t15

The voltage of the pad PAD(P) becomes equal to the value VU2 obtained after the change in the positive polarity input gradation voltage DAC(P) at timing which is slightly later than that of the positive polarity output gradation voltage OUT(P). It is now considered that a potential difference between the positive polarity gradation voltage of the pad PAD(P) and the positive polarity output gradation voltage OUT(P) during a period of time from time t13 to time t15 has transiently been absorbed by the conductive resistance of the positive polarity control switch SW(P), the floating capacitance of the line which reaches the pad PAD(P), and the like.

Similarly, the negative polarity gradation voltage of the pad PAD(N) becomes equal to the value VD2 obtained after the change in the negative polarity input gradation voltage DAC(N) at timing which is slightly later than that of the negative polarity output gradation voltage OUT(N). It is now considered that a potential difference between the negative polarity gradation voltage of the pad PAD(N) and the negative polarity output gradation voltage OUT(N) during the period of time from time t13 to time t15 has transiently been absorbed by the conductive resistance of the negative polarity control switch SW(N), the floating capacitance of the line which reaches the pad PAD(N), and the like.

Time t16

The control signal TP changes to the high level. The positive polarity control switch SW(P) which has so far been in the ON state is turned off. The feedback voltage to the (−) node of the input side of the positive polarity feedback amplifier AMP(P) is switched from the positive polarity output gradation voltage OUT(P) to the negative polarity gradation voltage of the pad PAD(N). This is because since the reverse signal REV is changed to the low level, the positive polarity operating circuit 1 is connected to the pad PAD(N) and the negative polarity operating circuit 2 is connected to the pad PAD(P). At this time, since the precharge signal SH is set to the high level, the negative polarity gradation voltage of the pad PAD(N) temporarily starts to decrease toward the intermediate voltage VM.

At this time, when the positive polarity input gradation voltage DAC(P) which has so far been maintained at VU2 starts to increase, the positive polarity feedback amplifier AMP(P) compares the positive polarity input gradation voltage DAC(P) with the negative polarity gradation voltage of the pad PAD(N), amplifies a difference between them, and outputs an amplified value. Since the negative polarity gradation voltage of the pad PAD(N) is changing toward the intermediate voltage VM, the positive polarity output gradation voltage OUT(P) starts to increase sharply.

Similarly, when the control signal TP changes to the high level, the negative polarity control switch SW(N) which has so far been in the ON state is turned off. The feedback voltage to the (−) node of the input side of the negative polarity feedback amplifier AMP(N) is switched from the negative polarity output gradation voltage OUT(N) to the positive polarity gradation voltage of the pad PAD(P). This is because since the reverse signal REV is changed to the high level, the positive polarity operating circuit 1 is connected to the pad PAD(N) and the negative polarity operating circuit 2 is connected to the pad PAD(P). At this time, since the precharge signal SH is set to the high level, the positive polarity gradation voltage of the pad PAD(P) temporarily starts to decrease toward the intermediate voltage VM.

At this time, when the negative polarity input gradation voltage DAC(N) which has so far been maintained at VD2 starts to increase, the negative polarity feedback amplifier AMP(N) compares the negative polarity input gradation voltage DAC(N) with the positive polarity gradation voltage of the pad PAD(P), amplifies a difference between them, and outputs an amplified value. Since the positive polarity gradation voltage of the pad PAD(N) is changing toward the intermediate voltage VM, the negative polarity output gradation voltage OUT(N) starts to increase sharply.

Time t17

When the positive polarity input gradation voltage DAC(P) reaches VU3, the positive polarity output gradation voltage OUT(P) reaches the power voltage VDD in association with it. At this time, the voltage of the pad PAD(N) is temporarily returned to the intermediate voltage VM.

Similarly, when the negative polarity input gradation voltage DAC(N) reaches VD3, the negative polarity output gradation voltage OUT(N) reaches the ground voltage VSS in association with it. At this time, the voltage of the pad PAD(P) is temporarily returned to the intermediate voltage VM.

Time t18

The control signal TP changes to the low level. The positive polarity control switch SW(P) which has so far been in the OFF state is turned on. The feedback voltage to the (−) node of the input side of the positive polarity feedback amplifier AMP(P) is switched from the voltage of the pad PAD(N) to the positive polarity output gradation voltage OUT(P). The positive polarity feedback amplifier AMP(P) starts the control operation that is inherent in the feedback amplifier for generating the output voltage which is equal to the positive polarity input gradation voltage DAC(P) irrespective of the magnitude of the parasitic capacitance of the connected capacitive load.

Similarly, when the control signal TP changes to the low level, the negative polarity control switch SW(N) which has so far been in the OFF state is turned on. The feedback voltage to the (−) node of the input side of the negative polarity feedback amplifier AMP(N) is switched from the voltage of the pad PAD(P) to the negative polarity output gradation voltage OUT(N). The negative polarity feedback amplifier AMP(N) starts the control operation that is inherent in the feedback amplifier for generating the output voltage which is equal to the positive polarity input gradation voltage DAC(P) irrespective of the magnitude of the parasitic capacitance of the connected capacitive load.

Time t19

By the feedback control of the positive polarity feedback amplifier AMP(P), the positive polarity output gradation voltage OUT(P) becomes equal to the value VU3 obtained after the change in the positive polarity input gradation voltage DAC(P). Similarly, by the feedback control of the negative polarity feedback amplifier AMP(N), the negative polarity output gradation voltage OUT(N) becomes equal to the value VD3 obtained after the change in the negative polarity input gradation voltage DAC(N).

Time t20

The positive polarity gradation voltage of the pad PAD(N) becomes equal to the value VU3 obtained after the change in the positive polarity input gradation voltage DAC(P) at timing which is slightly later than that of the positive polarity output gradation voltage OUT(P). It is now considered that a potential difference between the positive polarity gradation voltage of the pad PAD(N) and the positive polarity output gradation voltage OUT(P) during a period of time from time t18 to time t20 has transiently been absorbed by the conductive resistance of the positive polarity control switch SW(P), the floating capacitance of the line which reaches the pad PAD(N), and the like.

Similarly, the negative polarity gradation voltage of the pad PAD(P) becomes equal to the value VD3 obtained after the change in the negative polarity input gradation voltage DAC(N) at timing which is slightly later than that of the negative polarity output gradation voltage OUT(N). It is now considered that a potential difference between the negative polarity gradation voltage of the pad PAD(P) and the negative polarity output gradation voltage OUT(N) during the period of time from time t18 to time t20 has transiently been absorbed by the conductive resistance of the negative polarity control switch SW(N), the floating capacitance of the line which reaches the pad PAD(P), and the like.

Time t21

The control signal TP changes to the high level. The positive polarity control switch SW(P) which has so far been in the ON state is turned off. The feedback voltage to the (−) node of the input side of the positive polarity feedback amplifier AMP(P) is switched from the positive polarity output gradation voltage OUT(P) to the voltage of the pad PAD(N).

At this time, when the positive polarity input gradation voltage DAC(P) which has so far been maintained at VU3 starts to decrease, the positive polarity feedback amplifier AMP(P) compares the positive polarity input gradation voltage DAC(P) with the positive polarity gradation voltage of the pad PAD(N), amplifies a difference between them, and outputs an amplified value. Since the positive polarity input gradation voltage DAC(P) is smaller than the positive polarity gradation voltage of the pad PAD(N), the positive polarity output gradation voltage OUT(P) starts to decrease sharply. At the same time, since the transistor P is turned on, the positive polarity gradation voltage of the pad PAD(N) also starts to decrease.

Similarly, when the control signal TP changes to the high level. The negative polarity control switch SW(N) which has so far been in the ON state is also turned off. The feedback voltage to the (−) node of the input side of the negative polarity feedback amplifier AMP(N) is switched from the negative polarity output gradation voltage OUT(N) to the negative polarity gradation voltage of the pad PAD(P).

At this time, when the negative polarity input gradation voltage DAC(N) which has so far been maintained at VD3 starts to decrease, the negative polarity feedback amplifier AMP(N) compares the negative polarity input gradation voltage DAC(N) with the negative polarity gradation voltage of the pad PAD(P), amplifies a difference between them, and outputs an amplified value. Since the negative polarity input gradation voltage DAC(N) is smaller than the negative polarity gradation voltage of the pad PAD(P), the negative polarity output gradation voltage OUT(N) starts to decrease sharply. At the same time, since the transistor N is turned on, the negative 25 polarity gradation voltage of the pad PAD(P) also starts to decrease.

Time t22

When the positive polarity input gradation voltage DAC (P) reaches VU2, the positive polarity output gradation voltage OUT(P) reaches the intermediate voltage VM in association with it. At this time, since the transistor P is ON, the positive polarity gradation voltage of the pad PAD(N) also continues to decrease.

Similarly, when the negative polarity input gradation voltage DAC(N) reaches VD2, the negative polarity output gradation voltage OUT(N) reaches the intermediate voltage VM in association with it. At this time, since the transistor N is ON, the negative polarity gradation voltage of the pad PAD(P) also continues to decrease.

Time t23

The positive polarity gradation voltage at the pad PAD(N) becomes equal to VU2 at this time, a difference between the positive polarity input gradation voltage DAC(P) and the positive polarity gradation voltage of the pad PAD(N) becomes equal to 0, and the positive polarity output gradation voltage OUT(P) becomes equal to the positive polarity input gradation voltage DAC(P). Therefore, the transistor P is turned off. Thus, the decrease in the positive polarity gradation voltage at the pad PAD(N) is also stopped.

Similarly, the negative polarity gradation voltage at the pad PAD(P) becomes equal to VD2 at this time, a difference between the negative polarity input gradation voltage DAC (N) and the negative polarity gradation voltage of the pad PAD(P) becomes equal to 0, and the negative polarity output gradation voltage OUT(N) becomes equal to the negative polarity input gradation voltage DAC(N). Therefore, the transistor N is turned off. Thus, the decrease in the negative polarity gradation voltage at the pad PAD(P) is also stopped.

Time t24

The control signal TP changes to the low level. The positive polarity control switch SW(P) which has so far been in the OFF state is turned on. The feedback voltage to the (−) node of the input side of the positive polarity feedback amplifier AMP(P) is switched from the positive polarity gradation voltage of the pad PAD(N) to the positive polarity output gradation voltage OUT(P). The positive polarity feedback amplifier AMP(P) starts the control operation that is inherent in the feedback amplifier for generating the output voltage which is equal to the positive polarity input gradation voltage DAC(P) irrespective of the magnitude of the parasitic capacitor C1 of the connected capacitive load.

Similarly, when the control signal TP changes to the low level, the negative polarity control switch SW(N) which has so far been in the OFF state is turned on. The feedback voltage to the (−) node of the input side of the negative polarity feedback amplifier AMP(N) is switched from the negative polarity gradation voltage of the pad PAD(P) to the negative polarity output gradation voltage OUT(N). The negative polarity feedback amplifier AMP(N) starts the control, operation that is inherent in the feedback amplifier for generating the output voltage which is equal to the negative polarity input gradation voltage DAC(N) irrespective of the magnitude of the parasitic capacitor C2 of the connected capacitive load.

The operation similar to that mentioned above is repeated hereinbelow.

Although the invention has been described above while limiting to the case where the discharge accelerating unit or the charge accelerating unit comprises a field effect transistor in which the gate receives the positive polarity output voltage of the positive polarity feedback amplifier, the drain receives the positive polarity voltage of the capacitive load, and the source is maintained at the predetermined reference voltage, the invention is not limited to such an example. That is, an arbitrary kind of device can be used so long as it can switch the on/off operations.

Although the invention has been described above while limiting the control switch to the transistor switch constructed by a pair of p-type transistor and n-type transistor, the invention is not limited to such an example. That is, an arbitrary kind of switch can be used so long as it can receive the control signal and switch the on/off operations.

Since the discharge accelerating unit to accelerate the discharge of the capacitive load and the positive polarity input voltage increase/decrease detecting unit to detect the decrease in the positive polarity output gradation voltage OUT(P) are provided for the positive polarity operating circuit and the charge accelerating unit to accelerate the charge of the capacitive load and the negative polarity input voltage increase/decrease detecting unit to detect the decrease in the negative polarity output gradation voltage OUT(N) are provided for the negative polarity operating circuit as described above, the following effects are obtained.

1. Good image reproducing characteristics can be obtained irrespective of the switching period of the positive polarity operating circuit and the negative polarity operating circuit and the luminance levels of the adjacent dots.

2. Since the number of devices which are added by the invention is small, the increase in costs can be minimized.

3. Further, by providing the charge/discharge set-off unit for mutually connecting the charge accelerating unit and the discharge accelerating unit in the floating state, the current consumption of the whole circuit can be also reduced.

The present invention is not limited to the foregoing embodiment but many modifications and variations are possible within the spirit and scope of the appended claims of the invention.

What is claimed is:

1. A driving circuit for a liquid crystal display, comprising:

a positive polarity operating circuit having a positive polarity feedback amplifier which receives an input voltage of a positive polarity which increases/decreases in a positive direction from a predetermined reference voltage and outputs a voltage of a value which is equal to said positive polarity input voltage to a signal line that is connected; and a negative polarity operating circuit having a negative polarity feedback amplifier which receives an input voltage of a negative polarity which increases/decreases in a negative direction from said predetermined reference voltage and outputs a voltage of a value which is equal to said negative polarity input voltage to a signal line that is connected, wherein a discharge accelerating unit which accelerates a discharge of a capacitive load of said signal line when said positive polarity input voltage decreases is provided for said positive polarity operating circuit, and a charge accelerating unit which accelerates a charge to a capacitive load of said signal line when said negative polarity input voltage decreases is provided for said negative polarity operating circuit.

2. The driving circuit for a liquid crystal display according to claim 1, further comprising:

a positive polarity input voltage increase/decrease detecting unit which, when it receives a control signal, feeds back a positive polarity voltage of said capacitive load to an input side of said positive polarity feedback amplifier for a predetermined time and compares the positive polarity voltage of said capacitive load with said positive polarity input voltage, thereby detecting the increase/decrease in said positive polarity input voltage; and a negative polarity input voltage increase/decrease detecting unit which, when it receives said control signal, feeds back a negative polarity voltage of said capacitive load to an input side of said negative polarity feedback amplifier for a predetermined time and compares the negative polarity voltage of said capacitive load with said negative polarity input voltage, thereby detecting the increase/decrease in an absolute value of said negative polarity input voltage.

3. The driving circuit for a liquid crystal display according to claim 2, wherein:

said discharge accelerating unit comprises a p-type transistor, a gate of said p-type transistor receives the positive polarity output voltage of said positive polarity feedback amplifier, a drain of said p-type transistor receives the positive polarity voltage of said capacitive load, a source of said p-type transistor is maintained at said predetermined reference voltage, and when said positive polarity input voltage increase/decrease detecting unit detects the decrease in said positive polarity input voltage, said p-type transistor is turned on and allows said capacitive load to be discharged; and said charge accelerating unit comprises an n-type transistor, a gate of said n-type transistor receives the negative polarity output voltage of said negative polarity feedback amplifier, a drain of said n-type transistor receives the negative polarity voltage of said capacitive load, a source of said n-type transistor is maintained at said predetermined reference voltage, and when said negative polarity input voltage increase/decrease detecting unit detects the decrease in said negative polarity input voltage, said n-type transistor is turned on and allows said capacitive load to be charged.

4. The driving circuit for a liquid crystal display according to claim 3, wherein the source of said p-type transistor and the source of said n-type transistor are mutually connected in a floating state so as to compensate the charge/discharge to/from said capacitive load.

* * * * *